US005680666A

United States Patent [19]

Ra

[11] Patent Number: 5,680,666

[45] Date of Patent: Oct. 28, 1997

[54] AUTOMATIC POLISHING DEVICE

[76] Inventor: Dojin Ra, 18 E. Harwood Terr., Palisades Park, N.J. 07650

[21] Appl. No.: 730,067

[22] Filed: Oct. 15, 1996

[51] Int. Cl.[6] ..... A47L 23/05; A47L 23/06

[52] U.S. Cl. ..... 15/97.2; 15/29; 15/31

[58] Field of Search ..... 15/24, 29, 30, 15/31, 34–36, 97.2

[56] References Cited

U.S. PATENT DOCUMENTS

| | | | |
|---|---|---|---|
| 1,562,377 | 11/1925 | Spielman | 15/24 |
| 2,635,268 | 4/1953 | Pettie | 15/24 |
| 2,728,928 | 1/1956 | Beeren | 15/31 X |
| 2,841,806 | 7/1958 | Blasi | 15/24 |
| 3,235,897 | 2/1966 | Fortenberry | 15/24 |
| 3,251,086 | 5/1966 | Springer | 15/28 |
| 3,289,231 | 12/1966 | Minton et al. | 15/28 |
| 3,396,417 | 8/1968 | Starr | 15/29 |
| 3,404,420 | 10/1968 | Lachat et al. | 15/29 |
| 3,943,591 | 3/1976 | Lanussé | 15/29 |
| 4,312,091 | 1/1982 | Carous | 15/97.2 |
| 4,535,499 | 8/1985 | Cho | 15/24 |
| 4,827,551 | 5/1989 | Maser et al. | 15/24 |

FOREIGN PATENT DOCUMENTS

| | | | |
|---|---|---|---|
| 79938 | 1/1963 | France | 15/29 |
| 2355489 | 1/1978 | France | 15/34 |
| 2382882 | 10/1978 | France | 15/97.2 |
| 2407765 | 8/1975 | Germany | 15/24 |
| 3308134 | 9/1984 | Germany | 15/29 |
| 3904882 | 8/1989 | Germany | 15/31 |

*Primary Examiner*—Mark Spisich

*Attorney, Agent, or Firm*—Weingram & Associates, P.C.

[57] ABSTRACT

An automatic shoe polisher includes a casing having an internal chamber for a rechargeable battery and a liquid cartridge. A pair of doors provide for access to the battery and liquid cartridge. The door for the liquid cartridge is provided with a protrusion or biasing element to maintain the position of the liquid cartridge in the casing. A motor assembly is connected to a pinion which coacts with a shaft assembly to drive the cleaning/polishing element which is mounted to the shaft by a universal coupling. The coupling permits the polishing element to be pivoted about the shaft. A spring is arranged around the shaft to bias the shaft. A valve with an inlet is arranged on the shaft to move into the chamber so that the polishing fluid is directed through the shaft to the polishing element. The apparatus can be automatically actuated upon contact of the polishing head against the surface to be polished, such as a shoe, with the speed being variable depending upon the amount of pressure exerted on the polishing head. When pressure is removed from the polishing head, the valve is displaced so that the fluid in the chamber is retained in the chamber and the rotational speed of the shaft slows.

17 Claims, 1 Drawing Sheet

AUTOMATIC POLISHING DEVICE

BACKGROUND OF THE INVENTION

1. Field of the Invention

The present invention relates to polishing devices for shoes, and particularly, to powered automatic devices with a variable speed polishing head to follow the contour of the shoe for controlled distribution of cleaning and polishing substances thereon.

2. Description of the Related Art

Hand operated electric polishing devices include:

U.S. Pat. No. 2,635,268 to Pettie; U.S. Pat. No. 3,251,086 to Springer; U.S. Pat. No. 3,289,231 to Minton et al.; and U.S. Pat. No. 4,535,499 to Cho disclose devices for polishing shoes.

U.S. Pat. No. 2,841,806 to Blasi; U.S. Pat. No. 3,235,897 to Fortenberry; and U.S. Pat. No. 4,827,551 to Maser et al. disclose apparatus for brushing teeth and massaging mouth parts.

All of the devices disclose rotating brush elements for cleaning and/or polishing objects. Pettie and Cho disclose a reservoir for the polish and channels for stick polish application, respectively. Blasi discloses a tube member to which dentifrice is fed from a reservoir tube to a position external to the toothbrush bristles. Fortenberry and Maser also disclose reservoirs from which dentifrice and water can be fed to the cleaning or massaging bristles, respectively.

However, among the devices disclosed in the patents identified above, none disclose a shoe polishing device having, among other features, a universal coupling for the polishing head and a pressure sensitive switch which may automatically control a single or a variable speed motor to actuate and change the speed of rotation of the polishing element.

OBJECT AND SUMMARY OF THE INVENTION

The preferred embodiment of the present invention consists of a casing having an first internal chamber for a rechargeable battery and a second internal chamber to receive a liquid cartridge. A pair of doors provide for access to the battery and liquid cartridge chambers, respectively. The door for the liquid cartridge is provided with a protrusion or a spring to maintain and hold the position of the liquid cartridge in the casing. A motor assembly is connected to a pinion which coacts with a shaft assembly to drive the cleaning/polishing element which is mounted to the shaft by a universal coupling. A spring is arranged around the shaft to bias the polishing element along the shaft. A valve with an inlet is arranged to move into the chamber so that the polishing fluid is discharged and directed through the shaft to the polishing element.

The apparatus can be automatically actuated upon contact of the polishing head against the surface to be polished, such as a shoe, with the speed being variable depending on the amount of pressure exerted. When pressure is removed from the polishing head, the valve is displaced so that the fluid in the chamber is retained in the chamber.

The polishing head may be provided with channels or troughs for those instances where a substance of higher viscosity, thicker fluid such as a polishing cream, is to be dispensed. The channels or troughs retain and provide for more uniform application of the heavier cream substance on the surface to be polished.

It is a principal object and advantage of the present invention to provide an powered shoe polisher.

Another object and advantage of the invention is the provision of a powered shoe polisher which has a polish discharge mechanism which is controlled by the pressure of the polisher head on the shoe.

A still further object and advantage of the invention is the provision of an automatic shoe polisher which may be turned ON manually, or by applying the polishing head to a shoe with sufficient pressure.

Another object and advantage of the invention is the provision of a shoe polisher which has a variable speed motor.

Another object and advantage of the invention is the provision of an automatic switch to vary the speed of the motor as a function of the amount of pressure exerted by the polishing head on the shoe.

A still further object and advantage of the invention is the provision of a variable speed switch which is actuated by lateral movement of a spring biased shaft connected to the polishing head.

Another object and advantage of the invention is the provision of a pressure relief valve for the polish cartridge which operates by the lateral movement of a spring biased shaft connected to the polishing head.

An important object and advantage of the invention is the provision of a motorized shoe polisher where the lateral movement of a spring biased shaft connected to the polishing head controls both the speed of the motor and the application of polish to the polisher head.

BRIEF DESCRIPTION OF THE DRAWINGS

For a more complete understanding of the present invention, reference may be had to the following description of exemplary embodiments of the present invention considered in connection with the accompanying drawings, in which.

DETAILED DESCRIPTION OF THE PREFERRED EMBODIMENTS

Figure 1:
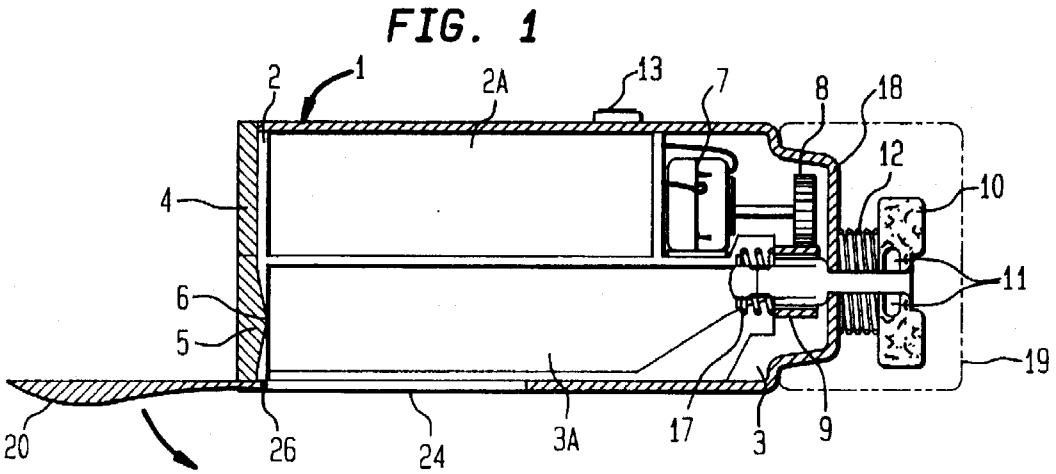
FIG. 1 is a cross-sectional view showing a preferred embodiment of an automatic polishing device according to the present invention.
Figure 2:
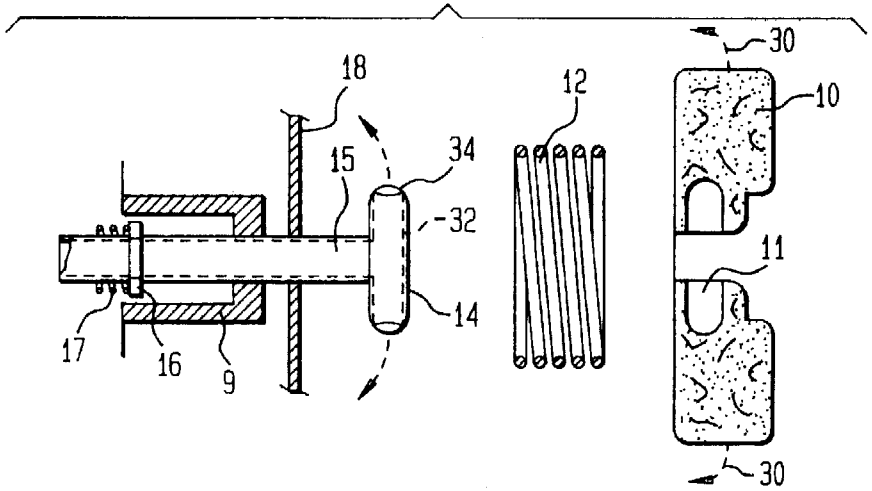
FIG. 2 is an exploded view of the polishing head elements of the present invention.

Referring to FIGS. 1 and 2, the automatic polishing device of the present invention is shown to include a casing 1 with a removable cap 19. The casing 1 has rear doors 4 and 5 to permit access to a compartment 2 for a battery 2A and a compartment 3 for a polish cartridge or container 3A. The compartment 2 can be structured with a separate compartment 3 for the cartridge 3A. Alternatively, the doors 4,5 can be constructed as a single access panel pivotally mounted to the casing 1 to access the compartment 2. The removable cap 19 covers a motor driven rotating polishing head 10. The polishing head includes soft material or foam conducive to polishing leathers, etc. The head 10 is mounted on shaft 15 and held in place by a universal joint 14. A spring 12 is mounted between the head 10 and a front wall 18 of the casing 1 to bias the head 10 and the shaft 15. The shaft 15 is laterally movable against the force exerted by spring 12.

The lateral movement of the shaft 15 is controlled by the amount of pressure exerted on the head 10 which causes the shaft 15 to move to the left, i.e. be compressed, as shown in FIG. 1 against the bias of the spring. This lateral movement of the shaft 15 may serve to control a switch (not shown) which varies the speed of a motor 7. Lateral movement of the shaft 15 also opens a spring loaded valve including spring 17 and washer 16 permitting liquid polish from cartridge 3A to flow into and through the hollow shaft 15 and thereafter through to the polishing head 10. The rotation of the cushionable material of the polishing head disperses the polishing fluid outward along the material of the head 10.

The preferred embodiment of FIGS. 1 and 2 consists of a casing 1 having internal chamber for the rechargeable battery 2A and another internal chamber to receive a pressurized liquid cartridge 3A. The doors 4, 5 provide for ingress and egress of the battery and liquid cartridge, respectively. The door 5 is provided with a protrusion 6 to maintain the position of the liquid cartridge 3A in the chamber 3 of the casing 1. A motor assembly 7 is connected to a pinion 8 which coacts with a shaft assembly 9 to drive the cleaning/polishing element 10 which is mounted to the shaft 15 by a universal coupling. A spring 12 is arranged around the shaft 15 and the front wall 18 of casing 1 to bias the polishing element 10 along the shaft 15. The valve including spring 17 and washer 16 about hollow shaft 15 is arranged to move into the chamber 3 so that the polishing fluid is discharged through the hollow shaft 15 to the polishing element 10.

The shaft 15 terminates in the universal joint 14. The joint interfits in apertures 11 in the polishing element 10 to hold the element 10 in place so that the contents of the cartridges 3A can be conveyed to the element 10 regardless of the angle to which the head 10 is pivoted, as shown by arrows 30. Alternatively, the universal joint can be constructed with a passage 32 extending therethrough in communication with the passage of the shaft 15. The fluid is dispersed from the passage 32 out through ports 34 in the polishing head 10.

When pressure is removed from the polishing head, the valve moves out of the cartridge 3A so that the fluid in the cartridge 3A is retained in the cartridge.

The polishing apparatus can be actuated by an ON-OFF switch 13. Alternatively, the apparatus may be automatically actuated upon contact of the polishing head 10 against the surface to be polished, such as a shoe, with the speed being variable depending upon the amount of pressure exerted.

The automatic operation described involves the use of a multi-speed motor and a switch coupled to the shaft 15. As the movement of the shaft increases by pressure on the polishing element 10, the motor speed changes as the shaft position responsive switch detects shaft position.

The polishing head 10 may be provided with channels or troughs 22 in those instances where a thicker fluid such as a polishing creme, is to be dispensed. The channels 22 retain and provide for more uniform distribution of the heavier creme substance on the surface to be polished.

Figure 3:
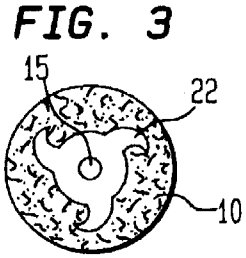
FIG. 3 is a front plan view of another embodiment of a polishing head of the present invention.
Figure 4:
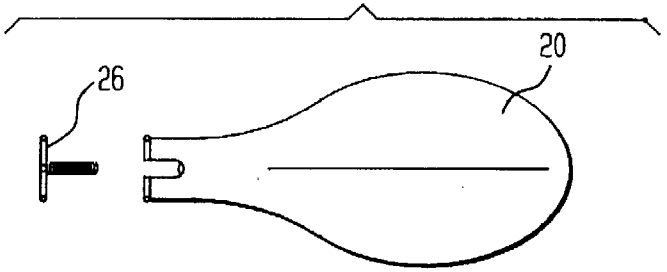
FIG. 4 is a plan view of a shoe horn element shown in FIG. 1.

For further convenience as shown in FIGS. 1 and 4, a shoe horn 20 may be foldably connected to the casing 1 to be extended therefrom. The horn 20 is shown in FIG. 1 extended for use and may fold into a storage area 24 constructed and arranged in the casing 1 to when the horn 20 is not in use. The horn 20 is pivotally connected to the casing 1 with a biased pivot member 26.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. An automatic shoe polisher, comprising:

a housing formed with an interior space;

a battery disposed at said interior space of said housing;

a container of polish disposed at said interior space of said housing;

a panel pivotally connected to said housing for permitting access to said interior space of said housing, said panel formed with a protrusion facing said interior space and for contacting said container;

a shaft disposed for reciprocating movement with respect to said housing, said shaft comprising a first end terminating at an exterior of said housing, a second end opposed to said first end and terminating at said interior space of said housing for coaction with said container, and a bore extending between said first and second ends;

a universal joint disposed on said first end of said shaft, said universal joint including a passage extending therethrough for communication with said bore of said shaft;

a polishing head removably mounted to said universal joint;

a valve disposed at said second end of said shaft for coaction with said bore and in communication with said container for providing a passage for the polish to flow from said container through said bore;

a spring mounted on said shaft between said polishing head and said housing for biasing said shaft;

a variable speed motor disposed at said interior space of said housing and connected to said battery and to said shaft for actuating said polishing head;

a switch connected to said variable speed motor and to said shaft; and a shoe horn pivotally connected to said housing;

wherein said shaft is movable to open said valve for said polish to flow through said bore to said polishing head, and to actuate said switch to adjust speed of said variable speed motor.

2. An automatic shoe polisher, comprising:

a housing formed with an internal chamber therein;

a power source disposed at said internal chamber;

a container of polish disposed at said internal chamber;

drive means mounted at said internal chamber and connected to said power source;

a hollow shaft moveable with respect to said housing and extending from said interior chamber to a position exterior to said housing, said hollow shaft connected to said drive means for rotational movement;

a polishing element mounted to said shaft;

bias means disposed on said hollow shaft between said polishing element and said housing to bias said hollow shaft; and valve means connected to said hollow shaft for coaction with said container to permit polish to flow through said hollow shaft to said polishing element when said shaft is moved laterally against said bias means.

3. Automatic shoe polisher of claim 2, wherein said drive means comprises:

a variable speed motor; and switch means connected to said variable speed motor and to said hollow shaft, wherein lateral movement of said hollow shaft signals said switch means to activate said variable speed motor to operate at a speed responsive to said lateral movement of said hollow shaft.

4. The automatic shoe polisher of claim 2, further comprising;

pivoting means attached to said hollow shaft to interconnect said hollow shaft with said polishing element and to permit said polishing element to pivot about said hollow shaft.

5. The automatic shoe polisher of claim 4, wherein said pivoting means is a universal joint.

6. The automatic shoe polisher of claim 4, wherein said pivoting means comprises:

a passage extending therethrough in communication with said hollow shaft to guide the polish to said polishing element.

7. The automatic shoe polisher of claim 2, further comprising:

a door mounted to said housing for providing access to said internal chamber of said housing.

8. The automatic shoe polisher of claim 7, further comprising:

retaining means disposed on said door for retaining said container in position at said internal chamber.

9. The automatic she polisher of claim 8, wherein said retaining means comprises:

a protrusion extending from said door to face said internal chamber and contact said container.

10. The automatic polisher of claim 2, further comprising:

a biasing element mounted to said hollow shaft at the internal chamber and proximate to said valve means for biasing the valve means in response to movement of the hollow shaft with respect to the container.

11. The automatic shoe polisher of claim 2, where said drive means comprises:

a variable speed motor, and switch means interconnecting said variable speed motor and said hollow shaft, said switch means responsive to lateral movement of said hollow shaft for controlling speed of said variable speed motor.

12. The automatic shoe polisher of claim 11, further comprising:

an ON-OFF switch connected to said drive means.

13. The automatic shoe polisher of claim 2, wherein the polishing element further comprises:

at least one channel extending along said polishing element in communication with said hollow shaft for distributing polish from said hollow shaft along said polishing element.

14. The automatic shoe polisher of claim 2, wherein said polishing element further comprises:

a plurality of channels radially extending outward from said hollow shaft along said polishing element for distributing polish from said hollow shaft along said polishing element.

15. The automatic shoe polisher of claim 2, further comprising:

a cover removably mountable to said housing for covering elements of said automatic shoe polisher at an exterior of said housing.

16. The automatic shoe polisher of claim 2, further comprising:

a shoe horn pivotally mounted to said housing.

17. An automatic shoe polisher, comprising:

a housing formed with an internal chamber therein;

power means disposed at said internal chamber;

containment means for polish disposed at said internal chamber;

applicator means constructed and arranged for reciprocating movement with respect to said housing, said applicator means comprising:

a first portion arranged at said internal chamber of said housing for communication with said containment means, and a second portion opposed to said first portion and arranged at an exterior of said housing, said second portion in communication with said first portion for receiving polish from said containment means and distributing it for polishing;

drive means mounted at said internal chamber of said housing and connected to said power means and said first portion of said applicator means;

wherein reciprocating movement of said applicator means effects the amount of polish to be guided from said containment means to said applicator means.

* * * * *